US005867105A

United States Patent [19]

Hajel

[11] Patent Number: 5,867,105

[45] Date of Patent: Feb. 2, 1999

[54] WIRELESS ALARM SYSTEM

[76] Inventor: William F. Hajel, 128 Eastern Dr., Lower Burrell, Pa. 15068

[21] Appl. No.: 897,279

[22] Filed: Jul. 21, 1997

Related U.S. Application Data

[63] Continuation-in-part of Ser. No. 735,799, Oct. 21, 1996, abandoned.

[51] Int. Cl.[6] ..... G08B 3/00

[52] U.S. Cl. ..... 340/691.3; 340/407.1; 340/502; 340/539; 340/628; 340/632; 340/693.5

[58] Field of Search ..... 340/691, 539, 340/407.1, 502, 529, 693, 628, 632, 326, 328, 825.44, 825.46, 340, 691.3, 693.5; 361/170; 379/37, 38, 52

[56] References Cited

U.S. PATENT DOCUMENTS

| | | | |
|---|---|---|---|
| 3,922,665 | 11/1975 | Curry et al. | 340/575 X |
| 3,998,209 | 12/1976 | MacVaugh | 340/566 X |
| 4,093,944 | 6/1978 | Muncheryan | 340/521 |
| 4,157,540 | 6/1979 | Oros | 340/573 X |
| 4,297,677 | 10/1981 | Lewis et al. | 340/407.1 X |
| 4,380,759 | 4/1983 | Sulkoski et al. | 340/407.1 |
| 4,421,953 | 12/1983 | Zielinski | 340/825.46 X |
| 4,777,474 | 10/1988 | Clayton | 340/407.1 X |
| 4,853,674 | 8/1989 | Kiss | 340/407.1 |
| 4,918,438 | 4/1990 | Yamasaki | 340/407.1 X |
| 5,012,226 | 4/1991 | Love | 340/576 |
| 5,646,589 | 7/1997 | Murray et al. | 340/825.46 X |
| 5,715,308 | 2/1998 | Shankarappa | 379/373 |

*Primary Examiner*—Thomas J. Mullen, Jr.
*Attorney, Agent, or Firm*—Daniel A. Sullivan, Jr.

[57] ABSTRACT

A wireless alarm system for generating alarm signals discernible to the hearing impaired. The system includes a detection unit having a smoke or carbon dioxide detector which generates a signal upon sensing the occurrence of smoke or carbon dioxide. A transmitter in the detector unit generates a wirelessly transmitted signal. A receiving unit worn on the body of a person includes a receiver and receives the signal generated by the transmitter. An alarm in the form of a vibrator is coupled with the receiver and generates a vibration discernible to the body of the user. A second alarm operates, or not, depending on whether the person acknowledges the vibrator.

18 Claims, 2 Drawing Sheets

WIRELESS ALARM SYSTEM

This is a continuation-in-part of application Ser. No. 08/735,799 filed Oct. 21, 1996 now ABN.

TECHNICAL FIELD

This invention relates to an alarm system for detecting the occurrence of a phenomenon such as the presence of smoke, the system being particularly adapted for use by the hearing impaired. Upon detection of smoke, for example, a wireless transmitted signal is sent to a receiver in a unit located by the user. An alarm such as a vibration is generated for being felt by the user.

BACKGROUND OF THE INVENTION

Smoke detectors of various designs are old and well known. Typically the components are coupled in a housing and the assembly is secured to the ceiling in an area of a residential or commercial dwelling. Most often various assemblies are installed throughout the dwelling. The components are most frequently energized by a battery. Whenever smoke is detected an electrical signal is usually transmitted to an audible alarm. The known smoke detectors are for all intents and purposes satisfactory to people with normal hearing capacity and in hearing range. The problem with these smoke detectors is that they do not provide an alarm signal which is discernible to the hearing impaired. The many hearing impaired cannot hear the audible alarm generated by the known and widely used smoke detectors and where smoke from a fire is detected, the hearing impaired may not realize the danger they would be in and may suffer serious injuries or death before they would realize the dangerous condition surrounding them.

DISCLOSURE OF INVENTION

This invention overcomes the serious limitation inherent in heretofore existing alarm systems by providing a system which generates an alarm discernible to the hearing impaired. This invention provides detectors for identifying the presence of smoke (or carbon dioxide, or other indicators of fire) and a transmitter responsive to a smoke- or fire-detected electrical signal for transmitting a wireless signal to a receiver in a unit located by the user. The receiver generates an electrical signal to an alarm such as a vibrator. The vibrator will pulsate at a magnitude to be felt by the user who will sense that a possible dangerous condition exists and will know to seek safety. If the user does not acknowledge the vibrator, a second alarm is presented to the user.

This invention provides a wireless alarm system, preferably a smoke and carbon dioxide detection and alarm system which comprises: detecting means for sensing the occurrence of a predetermined phenomenon such as the presence of smoke or carbon dioxide, and for generating a signal; transmitting means responsive to the signal from the detector means for generating a wirelessly transmitted signal indicative of the predetermined phenomena; receiving means in a unit remote from the detector means and the transmitter means for receiving the wirelessly transmitted signal and for generating an electrical signal; and alarm means responsive to the electrical signal for generating alarms discernible to the functioning senses of a hearing impaired person, as well as any other person. The alarm means has at least two parts. The first alarm means could be a vibrator, with the unit containing it being located by the person so that a generated vibration could be felt. The second alarm means stimulates the senses of the hearing impaired person differently than the first. When the first alarm means is a vibrator, the second alarm means could include a light source which could flash on and off and be readily observed by someone hearing impaired. In another example, the alarm means can be an electrical stimulator.

Various other advantages, details, and modifications of the present invention will become apparent as the following description of a certain presently preferred embodiment proceeds.

DESCRIPTION OF THE PREFERRED EMBODIMENTS

Figure 1:
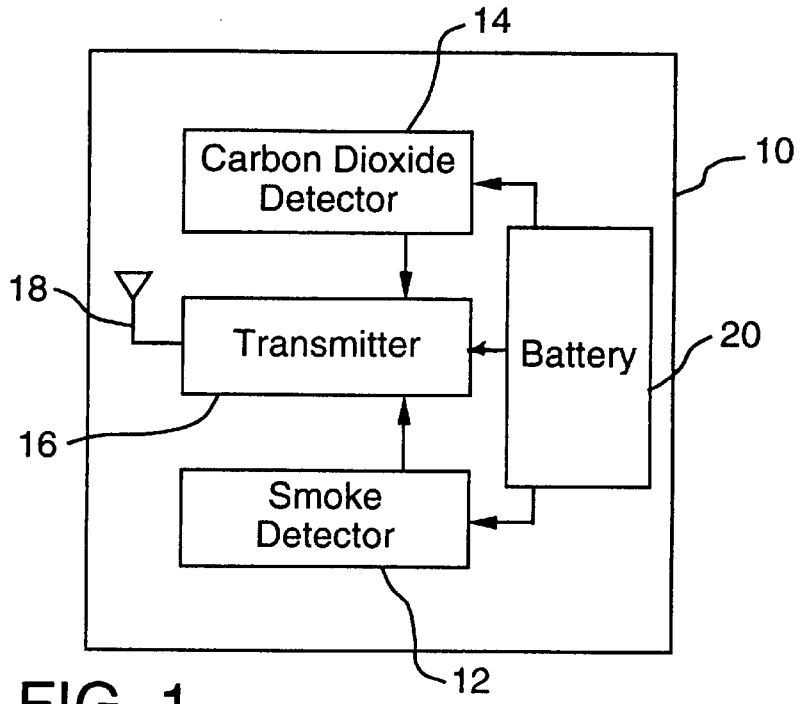
FIG. 1 is a schematic representation of a detector and transmitting unit constructed in accordance with the teachings of this invention.

Referring now to the drawings, FIG. 1 represents schematically a detector and transmitting unit 10 consisting of interconnected components, each of well known designs. The unit 10 may be secured in various locations of a dwelling much like prior art smoke and carbon dioxide detectors. The detector and transmitter unit 10 is provided with a smoke detector 12 and a carbon dioxide detector 14. Each detector 12 and 14 is electrically connected with a transmitter 16. The detectors 12 and 14 are provided with any well known signal generators responsive to the stimulus of detected smoke or carbon dioxide. Generated signals from the detectors 12 and 14 are sent to the transmitter 16 which responds to the smoke or carbon dioxide indicating signal and generates a wirelessly transmitted signal of, for example, short wave power at a selected frequency or frequencies. A transmitting antenna 18 transmits the smoke or carbon dioxide presence signal from the transmitter 16. The smoke detector 12, carbon dioxide detector 14, and transmitter 16 are powered by electrical energy derived from battery 20.

Figure 2:
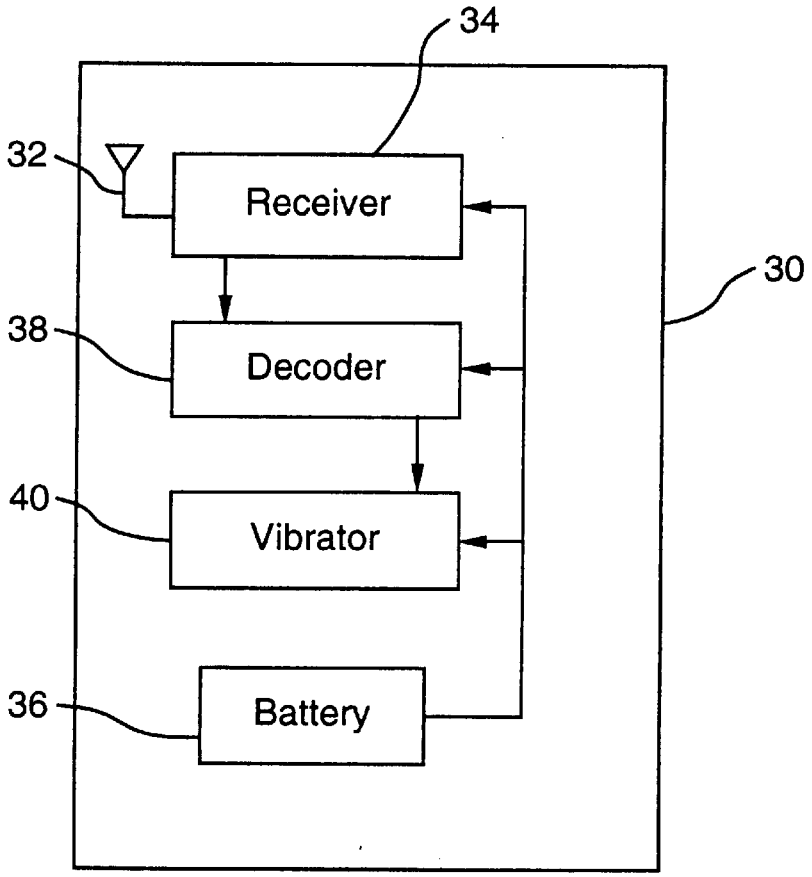
FIG. 2 is a schematic representation of a receiving and alarm unit, separate from the unit of FIG. 1, and typically worn on the person of the user, constructed in accordance with the teachings of this invention.

A receiving and alarm unit 30 is shown schematically in FIG. 2, and includes electrically connected elements all well known in the art. The receiving and alarm unit 30 would be formed in a compact assembly with a clip or the like provided for receiving onto the clothing of a user and would be within the range of the detector and transmitting unit 10. Receiving and alarm unit 30 is provided with a receiving antenna 32 which would pick up the signals generated by transmitter 18. The same smoke or carbon dioxide indicating signals are transferred to the input of a receiver 34. The receiver 34 transfers power from a battery 36 to a decoder 38 which is also energized by battery 36. The decoder 38 could include a code generator which would generate a code signal as pulses which in turn would be transferred to a vibrator 40 which is energized by battery 36. The vibrator 40 would pulsate in response to the electrical pulses received from the decoder 38. The pulsations from the vibrator 40 would be of such a magnitude and frequency to be readily discernible to the person wearing a receiving and alarm unit 30.

It should now be clearly understood how the alarm system of this invention provides positive and sure detection by hearing impaired people of the presence of a potentially dangerous smoke or fire condition. No audible alarm would satisfy the need of the hearing impaired. The smoke, fire, or gaseous presence alarm, however, could be visual. Instead of a vibrator the alarm could include a light source which would pulsate on and off in response to a coded signal. A receiver and alarm unit could be formed to be attached to a bed or chair with a significant alarm signal being generated to shake the bed or chair to positively alert the user of the existence of smoke or fire. It should also be noted that those with normal hearing could benefit by this invention by using a vibrator receiving and alarm unit where they might be in a high noise level place and unable to clearly hear audible alarm signals.

FIGS. 1 and 2 represent one way of alerting a person of a detected fire using a transmitter, receiver, and vibrator. Other ways of accomplishing this are shown in U.S. Pat. Nos. 4,093,944, 4,380,759, and 4,853,674 (hereinafter referenced, respectively, as '944, '759, and '674). These three patents are incorporated here by reference, for the purpose of illustrating alternative means of driving a vibrator upon detection of actual or impending fire. The embodiments of these three patents may as well be applied in the present invention.

Figure 3:
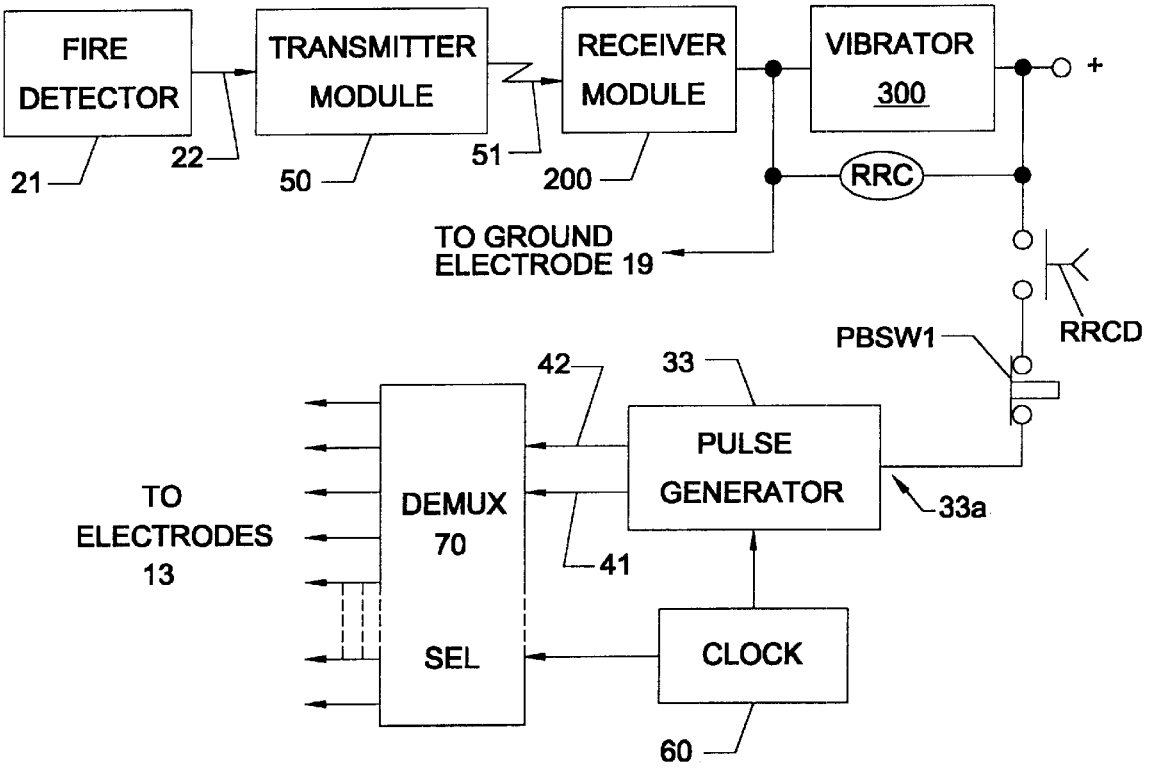
FIG. 3 is a schematic representation of combined detecting, transmitting, receiving, and alarm units, in accordance with the teachings of this invention.

FIG. 3 is an example of how any one of the four systems, i.e. that of FIGS. 1 and 2, and the three of '944, '759, and '674, can be combined with a second alarm, which may be of a different character and/or more intense than that of the first, which, by way of example, is a vibrator. For example, '944 indicates that vibrations may, in certain cases, even be sleep inducing. Thus, according to the invention, if, for one reason or another, the person to be warned fails to notice the first alarm, then a second alarm comes into play, to apply a different stimulation than the first. For example, the stimulation can be of a different type and/or the stimulation can be more intense. The more intense stimulation may be achieved either by choice of a more sensitive location of the body or by using an alarm whose emissions have a greater effect on the body, an example of this last being direct application of electricity of sufficiently heightened intensity to the body.

FIG. 3 uses the system of '674 as one component for illustrating how this feature of the invention works. The teachings of U.S. Pat. No. 4,926,879 (hereinafter '879), which patent is incorporated here by reference, are utilized to provide the second alarm. Rather than the mechanical vibrations of the first alarm, '879 provides the means to apply electricity directly to the individual. Thus, '879 provides stimulation of a different type, and this kind of stimulation can be more intense, as well.

In FIG. 3, the same reference characters used in '674 and '879 have been used, to the extent that there is no conflict with the reference characters already used in FIGS. 1 and 2. With reference to FIG. 3, transmitter module 50 and receiver module 200 are as shown in '674, except that vibrator 300 (internal vibrator 30 in '674) is shown external to the receiver module, in order to show how the system of '674 is coordinated with the alarm of '879. It is also preferred not to use timer 310 and transistor 312 of '674; these would operate to turn off the vibrator automatically, and such is not desired when warning of fire. When the individual wishes to stop the vibrator or other alarm, it is preferred that such be done by intentional intervention of the individual, who switches-off the battery power.

In FIG. 3, fire detector 21 can signal actual or impending fire by simple switch closure on line 22 into transmitter module 50, and this condition is transmitted, as indicated by jagged line 51, to receiver module 200, to turn-on vibrator 300. Electrical current flows from the + battery connection, displayed in the upper right of FIG. 3, to ground in the receiver module 200, and the battery voltage then exists across vibrator 300.

The portion of FIG. 3 below the top four boxes 21, 50, 200, and 300 shows how portions of '879 are interconnected with the system of '674, to bring in the second alarm, if the individual fails to acknowledge the first alarm provided by the vibrator. Relay RRC is connected across vibrator 300. Relay RRC drives the normally open, timed closing contact RRCD connected on one side to the plus pole of the battery and on the other side in series with an on-off, latching-type, push-button switch PBSW1.

Further information on time delay relay equipment is provided in INDUSTRIAL SOLID-STATE ELECTRONICS, DEVICES AND SYSTEMS, by T. J. Maloney, Prentice-Hall, 2nd Ed., 1979, pgs. 68–70, incorporated here by reference. Relay RRC may include a time-delay adjustment capability, so that the timed closing of contact RRCD may be chosen within a range of 5 to 120 seconds. It is recognized that solid-state equivalents of relay RRC and contact RRCD may be used.

A latching-type push-botton switch alternately opens and closes the circuit, as the button is pushed, in contrast to momentary closing or opening push-button switches. Preferably, switch PBSW1 is equipped with a light-emitting diode (not shown), which is lit when the switch is closed, since that is the state that the user will want to have it in, in order to have the second alarm come on, if the individual fails to notice the first alarm.

The push-button switch leads, in turn, to the input 33*a* (numbered 34 in FIGS. 4 and 5 of '879) of pulse generator 33. Pulse generator 33, clock 60, lines 41 and 42, demultiplexer 70, and electrodes 13 and 19 are as disclosed in '879.

Figure 4:
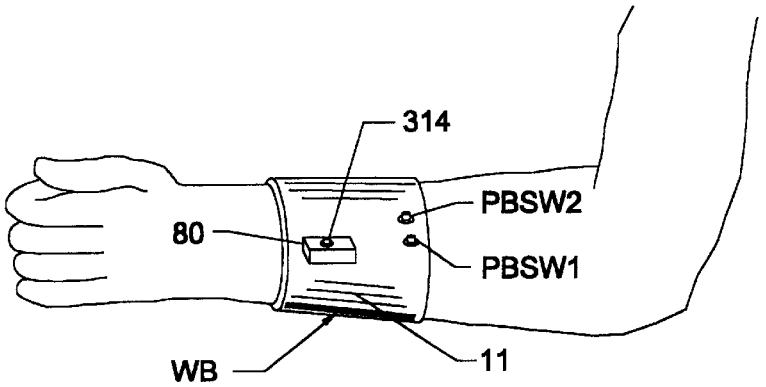
FIG. 4 is a perspective view illustrating the invention applied to the arm of an individual.

FIG. 4 shows the integration of receiver module 200, vibrator 300, relay RRC, contact RRCD, pulse generator 33, clock 60, and demultiplexer 70 in housing 80 on wrist band WB. Switch PBSW1 is exposed for operation by the individual. Latching push-button switch PBSW2 is provided for alternatively connecting or disconnecting a battery in housing 80 from the + connection on vibrator 300 in FIG. 3; this permits the individual to deactivate the alarms after leaving an area of danger. Reset switch 314 of '674 is additionally exposed on the top of housing 80. Substrate 11 carries electrodes 13 and ground electrode 19 and causes them to bear against the skin of the individual.

Operation of the embodiment of FIGS. 3 and 4 is as follows. Sensing of smoke, carbon dioxide, heat, or the like by fire detector 21 directs a signal of such through line 22 to transmitter module 50. Transmitter module 50 broadcasts a signal indicative of fire, as indicated by line 51, and such signal is picked up by receiver module 200. Vibrator 300 begins to vibrate. Details of how this happens is explained in '674. Lower power consumption circuitry is employed, to make battery operation feasible.

The voltage drop that occurs across vibrator 300 activates relay RRC, such that it wants to close its normally open contact RRCD. However, the time-delay characteristic of the contact prevents its immediate closure. A delay of 15 seconds is suitable, but other delays may be chosen, depending on the circumstances.

When the individual senses the vibrator alarm before the delay time has run out, acknowledgement can be indicated by pushing switch PBSW1, to open the switch. This prevents activation of the second alarm, when contact RRCD closes.

If, instead, the individual fails to notice the first alarm within the time delay, then, with both switches RRCD and PBSW1 closed, battery voltage from the + side of the vibrator is applied to the input 33*a* of the pulse generator 33. Whereas in '879, 32 separate frequency band intensities are applied sequentially at the input of the pulse generator, in this example of the present invention the input voltage to the pulse generator is constant during the time that a fire is being detected and switches RRCD and PBSW1 are closed. As a result, here each of the electrodes 13 of '879 in turn issues the same positive and negative pulses of electricity, which flow in one direction or the other through the individual and then through the ground electrode 19 to ground. The stimulation voltage can be adjusted by choice of gain, as explained in '879, and this feature can be used in the present invention to adjust the second alarm as appropriate for the given individual.

During a time when fire detector 21 is indicating a fire, the user can deactivate the vibrator 300, and the electrodes 13 if they are operating, by pushing PBSW2 on the wrist band WB in FIG. 4, to disconnect the battery from the + pole in FIG. 3. When the emergency is over, i.e. no signal any longer from detector 21, the device of the invention can be placed in the ready condition again, by closing switches PBSW1 and 2 and pressing reset button 314.

Another second alarm utilizing electricity in the body is disclosed in U.S. Pat. No. 4,813,419, and is incorporated here by reference, as suitable for use with any of the four vibrator alarm systems referenced above.

While I have shown and described presently preferred embodiments of this invention, it is to be distinctly understood that the invention is not limited thereto but may be otherwise embodied within the scope of the following claims and equivalents thereof. For instance, it is recognized that the same effect as achieved by the hardware mechanism of FIGS. 3 and 4 may be achieved by a mechanism in the form of a computer and software, for instance a microcontroller controlled by a program stored in read-only memory to activate the first alarm, and depending on the state of PBSW1, the second alarm. Also, while the embodiment of FIGS. 1 and 2 utilizes a code signal which pulsates for driving the vibrator, it is recognized that the code signal may, for instance, as well be a current injected at the base of a transistor switch, to turn a vibrator on, in the manner done in '674.

What is claimed is:

1. An alarm system comprising:

a detector which generates a signal indicating the presence of fire; and first and second alarms responsive to said signal for stimulating the functioning senses of an individual, the second alarm stimulating the senses of an individual differently than the first, the second alarm having a delayed operation compared to the first.

2. An alarm system as claimed in claim 1, further comprising a switch by which the first alarm can be acknowledged, operation of the switch for acknowledgement making the second alarm inoperable.

3. An alarm system as claimed in claim 2, the first alarm comprising a vibrator, the second alarm comprising means for applying electricity to an individual.

4. An alarm system comprising: a first alarm, a second alarm, an on-off switch operable by an individual between closed and open states, and an electrical mechanism which activates the second alarm after the first alarm, depending on whether the switch is in the closed or open state, the second alarm being electrically connected to the first alarm through a normally open timed closing switch, the second alarm being electrically connected to the first alarm through said on-off switch.

5. An alarm system as claimed in claim 4, the on-off switch being in series with the normally open timed closing switch.

6. An alarm system as claimed in claim 4, the first alarm comprising a vibrator.

7. An alarm system as claimed in claim 4, the second alarm comprising an electrical stimulator.

8. A wireless alarm system comprising:

detector means for sensing the presence of fire and generating a signal;

transmitting means responsive to said signal from said detector means for generating a wirelessly transmitted signal indicative of the presence of fire;

receiving means remote from said detector means and said transmitter means for receiving said wirelessly transmitted signal and generating a code electrical signal;

first alarm means responsive to said code electrical signal for generating an alarm discernible to the functioning senses of hearing impaired people; and second alarm means delayed with respect to the first alarm means and operable, or not, depending on whether there has been acknowledgement of the first alarm means.

9. A wireless alarm system as set forth in claim 8 wherein said detector means senses the occurrence of smoke and generates a signal indicative of the presence of smoke.

10. A wireless alarm system as set forth in claim 8 wherein said first alarm means is a vibrator responsive to said code electrical signal to create a vibration discernible to the functioning senses of hearing impaired people.

11. A wireless alarm system as set forth in claim 8 wherein said receiving means and both said alarm means are coupled in a unit constructed and arranged to be worn on the body of a person.

12. A wireless alarm system as set forth in claim 10 including decoder means coupled with said receiving means for receiving said code electrical signal to generate code signals to said vibrator for pulsing said vibrator.

13. A method of using an alarm system comprising: a detector which generates a signal indicating the occurrence of a predetermined phenomenon; and first and second alarms responsive to said signal for stimulating the functioning senses of an individual, the second alarm stimulating the senses of an individual differently than the first, the second alarm having a delayed operation compared to the first, said method comprising:

providing as the detector one which generates a signal indicating the presence of fire;

placing the detector at a location to be monitored; and placing the alarms such that they can stimulate the senses of an individual.

14. A method as claimed in claim 13, the alarm system further comprising a switch by which an individual can acknowledge the first alarm, operation of the switch for acknowledgement making the second alarm inoperable.

15. A method as claimed in claim 14, the first alarm comprising a vibrator, the second alarm comprising means for applying electricity to an individual.

16. A method as claimed in claim 14, said method further comprising placing the alarms and switch on an individual.

17. A method as claimed in claim 14, the detector comprising a smoke detector.

18. A method as claimed in claim 14, the detector comprising a carbon dioxide detector.

* * * * *